US008049574B2

(12) United States Patent
Wolfe et al.

(10) Patent No.: US 8,049,574 B2
(45) Date of Patent: Nov. 1, 2011

(54) HIGH POWER UHF SINGLE-POLE MULTI-THROW SWITCH

(75) Inventors: Allen R. Wolfe, Sauquoit, NY (US); Robert S. Long, New Hartford, NY (US); John C. Lopacki, Cicero, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 227 days.

(21) Appl. No.: 12/467,615

(22) Filed: May 18, 2009

(65) Prior Publication Data

US 2010/0289597 A1 Nov. 18, 2010

(51) Int. Cl.
*H01P 1/15* (2006.01)
*H01P 1/10* (2006.01)

(52) U.S. Cl. ..... 333/103; 333/104

(58) Field of Classification Search ..... 333/101, 333/103, 104, 107, 258
See application file for complete search history.

(56) References Cited

U.S. PATENT DOCUMENTS

| | | | | |
|---|---|---|---|---|
| 3,436,691 | A | 4/1969 | Hoffman et al. | |
| 3,503,014 | A | 3/1970 | Hall et al. | |
| 3,790,908 | A | 2/1974 | Burns | |
| 4,241,360 | A | 12/1980 | Hambor et al. | |
| 4,371,851 | A | 2/1983 | Niehenke et al. | |
| 4,486,722 | A | 12/1984 | Landt | |
| 4,739,247 | A | 4/1988 | Cisco et al. | |
| 5,109,205 | A * | 4/1992 | Hart et al. | 333/104 |
| 5,274,343 | A | 12/1993 | Russell et al. | |
| 5,519,364 | A * | 5/1996 | Kato et al. | 333/103 |
| 5,783,975 | A | 7/1998 | Nakamura | |
| 6,014,066 | A | 1/2000 | Harberts et al. | |
| 6,296,565 | B1 * | 10/2001 | Kenkel et al. | 455/277.2 |
| 6,552,626 | B2 | 4/2003 | Sharpe et al. | |
| 6,794,734 | B2 | 9/2004 | Hoag et al. | |
| 7,049,181 | B2 | 5/2006 | Hoag et al. | |
| 2008/0197858 | A1 | 8/2008 | Martens et al. | |

OTHER PUBLICATIONS

International Search Report dated Aug. 23, 2010 for related International application No. PCT/US2010/035211.
Tantawi et al., "Active and Passive RF Components for High-Power Systems", Sep. 2002.

* cited by examiner

*Primary Examiner* — Dean Takaoka
(74) *Attorney, Agent, or Firm* — Howard IP Law Group, PC

(57) ABSTRACT

A single pole multiple-throw switch for switching an RF signal to one of a plurality of outputs includes coupling the signal to a throw junction, said junction having connected thereto a plurality of switch legs, each leg includes a high voltage shunt diode spaced one quarter-wavelength from the throw junction; each diode mounted at its cathode end to a capacitor and adapted to receive a bias; wherein a controller applies a first DC bias to a selected one of the diodes to cause the selected diode to operate in reverse bias mode, such that the selected diode mounted on the corresponding capacitor provides a low insertion loss to pass the RF signal from the transmission line through the selected leg and to one of the outputs; and applies a second DC bias to the other diodes to cause the other diodes to operate in forward bias mode such that the other diodes mounted onto the corresponding capacitor provides a high insertion loss for blocking the RF signal to the remaining outputs.

20 Claims, 8 Drawing Sheets

HIGH POWER UHF SINGLE-POLE MULTI-THROW SWITCH

FIELD OF INVENTION

The present invention relates generally to electrical high frequency high power electronically controlled switches that pass high current at a low impedance.

BACKGROUND

Airborne radar systems have an ongoing requirement to switch high radio frequency ("RF") signals. The prior art provides switches that are often contained in large packages and do not allow design flexibility insofar as electronic switch control. In fact, presently there exists a lack of commercially available high peak, high average power single pole, single or multi-throw switches capable of handling 10-25 kilowatt ("kW") for use in electronic applications generally and more particularly airborne radar/electronic warfare applications. Furthermore, the prior art does not offer an Ultra High Frequency ("UHF") switch in the same package as its digitally controlled circuits. Finally, the prior art offers no acceptable product that takes into account the multiple requirements of low insertion loss, high off-arm isolation, and low-risk switch bias/control injection to support operation exceeding 10 kW operation.

Therefore, a switch is needed that is small, low cost, highly reliable, and has high current capacity providing high power handling capability and low impedance to interconnect RF subsystems.

SUMMARY OF THE INVENTION

The present invention relies in part on recognition of the aforementioned problems, and in providing a solution for a high power RF switch that that passes high current and high power handling capability from an RF input source through low impedance to an output.

According to an aspect of the present invention, a single pole multiple-throw microwave switch for selectively switching an RF signal to one of a plurality of output ports comprising: a transmission line for coupling the signal to a single or multi-throw junction, the throw junction having connected thereto a plurality of switch legs, each said leg including a high voltage shunt diode spaced about one quarter-wavelength from the throw junction; each said diode mounted at its cathode end to a corresponding Direct Current ("DC") blocking capacitor and adapted to receive a bias voltage; wherein a controller applies a first DC bias voltage to a selected one of the shunt diodes to cause the selected shunt diode to operate in a reverse bias mode such that the selected shunt diode mounted on the corresponding capacitor provides a low insertion loss to pass the signal from the transmission line through a selected leg and to a selected output port, and the controller applies a second DC bias voltage to the other shunt diodes to cause the other shunt diodes to operate in a forward bias mode, wherein the other shunt diodes provide a high insertion loss for blocking the signal from the transmission line to the remaining plurality of output ports.

According to another aspect of the present invention a single-pole multi-throw microwave assembly for switching an RF signal from an input port to a selected one of a plurality of output ports comprising: a conductive housing wherein an RF circuit mounts in electrical isolation on one side of said housing and a controller circuit in electrical isolation mounts on an opposite side of said housing; said RF circuit includes a throw junction attached thereto a plurality of switch legs, each of said switch legs attached to an associated single shunt silicon PIN diode having an anode connected to and spaced about ¼-wavelength from the throw junction, wherein said PIN diode also includes a cathode that connects to the controller for applying a DC bias and further mounts in electrical contact to an upper plate of a capacitor; and wherein said capacitor includes a lower plate in electrical contact to the housing; and wherein each of said switch legs further attach to the output for providing a low impedance connection between the input port and the selected one of the plurality of output ports dependent upon the controller for applying a DC bias.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION

It is to be understood that the figures and descriptions of the present invention have been simplified to illustrate elements that are relevant for a clear understanding, while eliminating, for the purpose of clarity, many other elements found in switch technology and methods of making and using each of the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

Figure 1A:
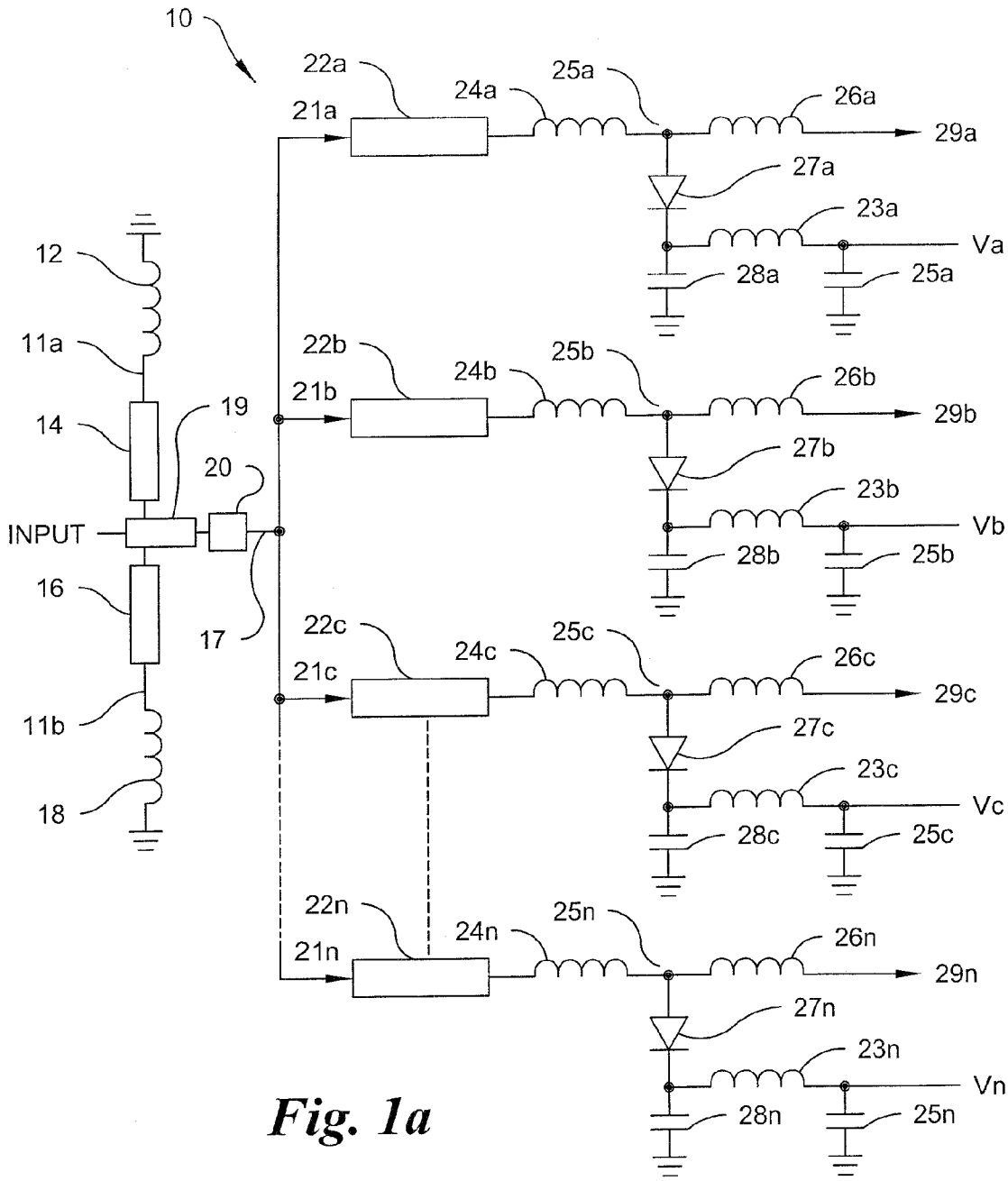
FIG. 1*a* is an electrical schematic of the switch according to an embodiment of the present invention.

FIG. 1*a* is an electrical schematic of the switch according to an embodiment of the present invention. The RF high power single-pole multi-throw switch 10 provides for low insertion loss, high off-arm isolation, and low-risk switch bias/control injection to support RF operation in excess of 10 kW. As further described below, the switch topology utilizes single shunt silicon PIN diodes 27*a-n* for each switch leg 21*a-n,* spaced about ¼-wavelength from the throw junction 17. There is one shunt PIN diode per each of the switch legs. A low risk bias injection Va-n is achieved by coupling (e.g. soldering) each PIN diode 27*a-n* (cathode-side of package) onto a large chip capacitor 28*a-n*. In one embodiment the capacitor 28*a-n* is soldered to a carrier assembly, which is attached to the metal floor housing which serves as circuit ground. The bias Va-n is injected via RF chokes 23*a-n* to the top of the chip capacitor 28*a-n*. By way of illustration, throw of the switch leg 21*a* is set to a low insertion loss state by reverse biasing PIN diode 27*a* by applying a positive DC voltage Va, while the remaining switch legs 21*b-n* continue in a high insertion loss (isolation) state by an applied negative voltage Vb-n to the remaining PIN diodes 27*b-n,* effectively blocking the signal from the transmission line to the remaining plurality of output ports 29*b-n*. The switch 10 input connects the RF signal to output 29*a* which in turn connects to by way of example, a microstrip circuit. As will be further described below, a controller 600 (FIG. 6) controls the switch legs 21*a-n* by applying either a positive or negative bias Va-n to each diode 27*a-n* of the switch 10.

With further reference to FIG. 1*a*, switch 10 includes a transmission line 19 connected to throw junction 17, which is connected to switch legs 21*a-n*. Each diode 27*a-n* is configured to be biased with the DC bias voltage Va-n. Each cathode of the diodes 27*a-n* is connected to the respective DC blocking capacitor 28*a-n*. Each mounted diode onto its respective capacitor provides a series resonance with the diode inductance. In part the capacitance provided for blocking capacitor 28*a-n* is a result of tuning, through the addition of capacitors in parallel. In one embodiment a total capacitance of 46 picofarads ("pf") is achieved by as many as three parallel capacitors having values of 23 pf, 11 pf and 12 pf. The switch 10 includes shunt lines 11*a-b* that connect to the transmission line 19 to provide a DC path for current flowing through the nonselected diodes. As indicated in FIG. 1*a*, the shunt lines includes a series inductors 12, 18 and corresponding transmission lines 14, 16 that in turn connect to transmission line 20, which has the equivalent resistance of transmission line 19. The PIN diodes 27*a-n* connect to corresponding nodes 25*a-n* that join to respective input inductors 24*a-n* and respective output inductors 26*a-n*. As further illustrated transmission lines 22*a-n* join the input inductors 24*a-n* to the throw junction 17.

Figure 1B:
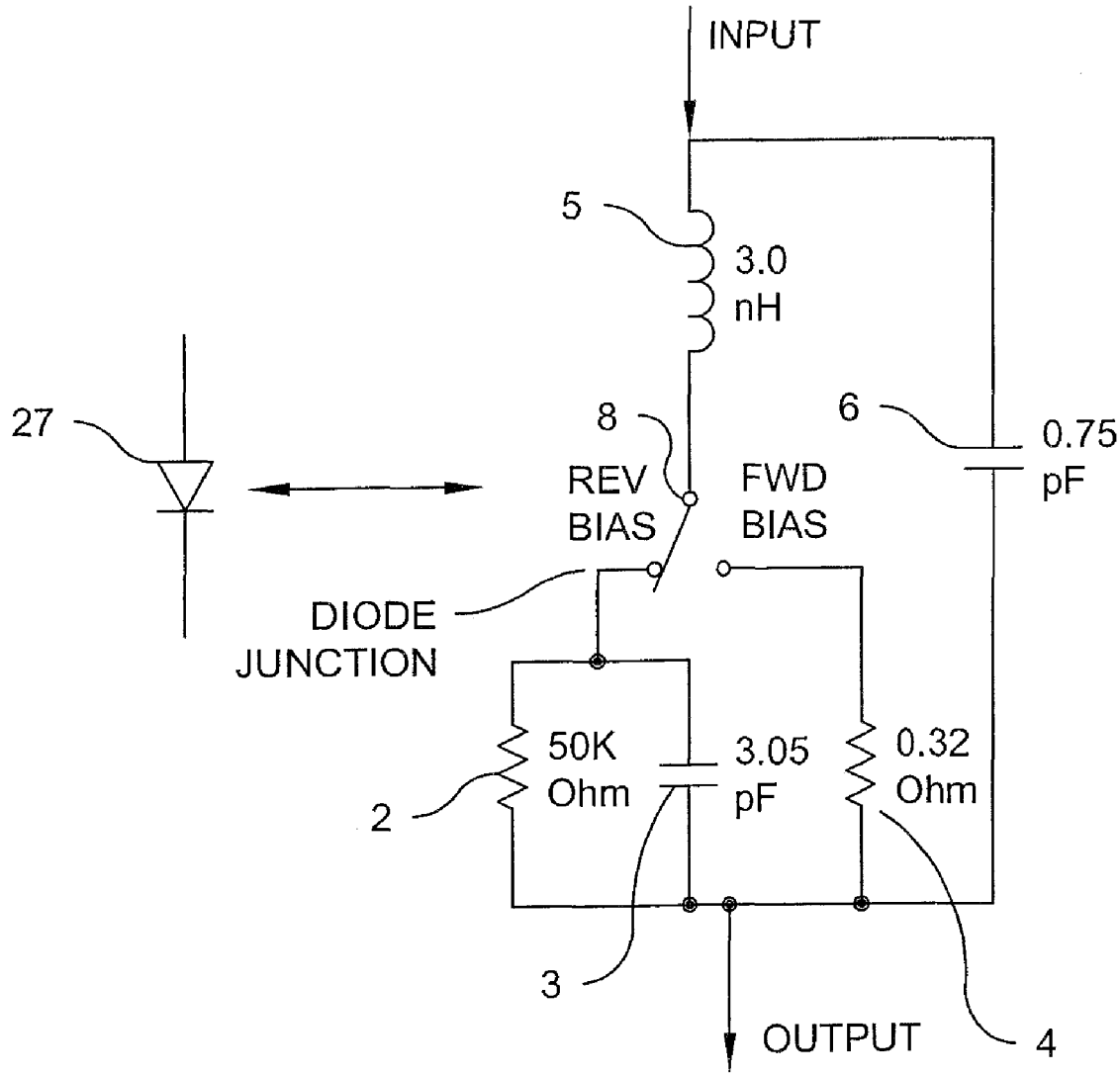
FIG. 1*b* is an electrical schematic an equivalent circuit of a PIN diode according to an embodiment of the present invention.

The schematic circuit for diode 27 shown in FIG. 1*b* represents the equivalent circuit for each of the diodes 27*a-n* (FIG. 1*a*). The equivalent circuit serves in part as a basis for choosing the materials having physical properties, dimension, form and typology, such that the PIN diodes in association with the respective large chip capacitor 28*a-n* provides the series resonance inductance necessary for establishing a low insertion loss (FIG. 7*a*, 710) during a selected throw of one switch leg. In one embodiment the equivalent circuit having typical component values as shown for illustration purposes only includes inductor 5 in series with the forward and reverse biased diode junction 8. In the reversed bias mode the junction is in series with an equivalent resistor 2 in parallel with a capacitor 3. In the forward biased mode a resistor 4 is in series with the diode junction. A capacitor 6 represents the package parasitic capacitance that connects the diode anode or input to the diode cathode or output.

Figure 7A:
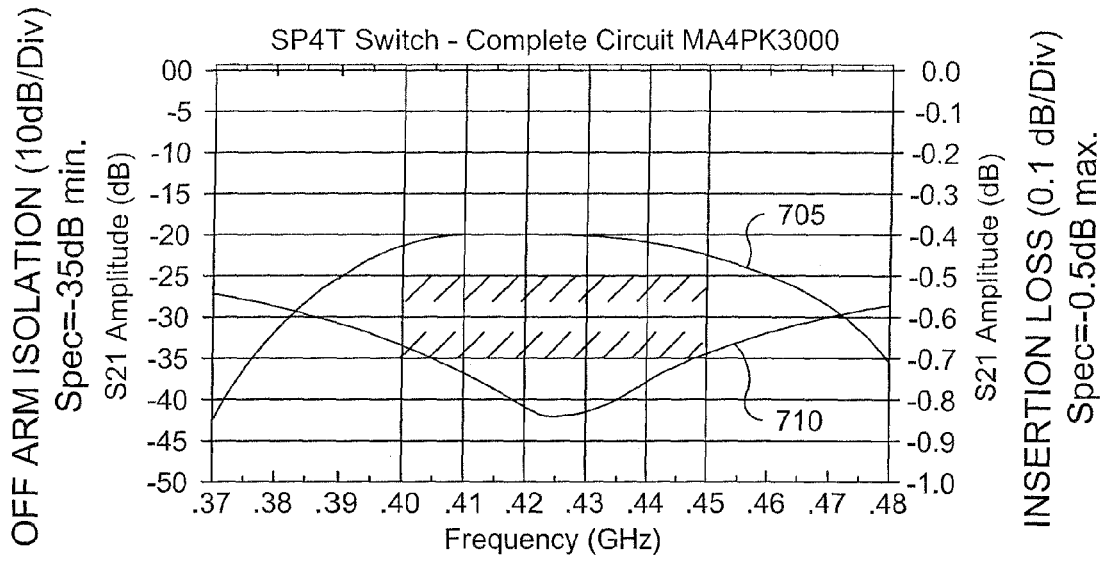
FIGS. 7*a-b* are graphs illustrating the isolation and the admissibility of a switch according to an embodiment of the present invention.
Figure 7B:
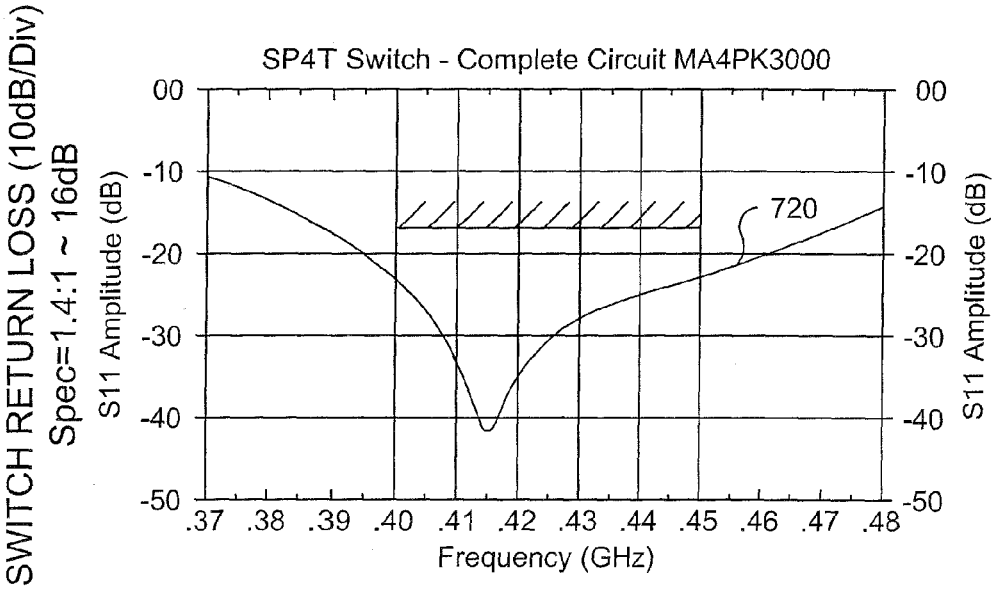

FIG. 7*a* illustrates a representative range of frequencies against corresponding performance of the switch, wherein a selected throw of one switch leg establishes a low insertion loss 705 between the RF source and the selected output. The on condition of the forward biased diodes establishes high off-arm isolation 710. As noted in FIG. 7*b*, 720, the switch return loss is minimal in the region in which the switch functions to pass the RF frequency of interest to the output.

Figure 2:
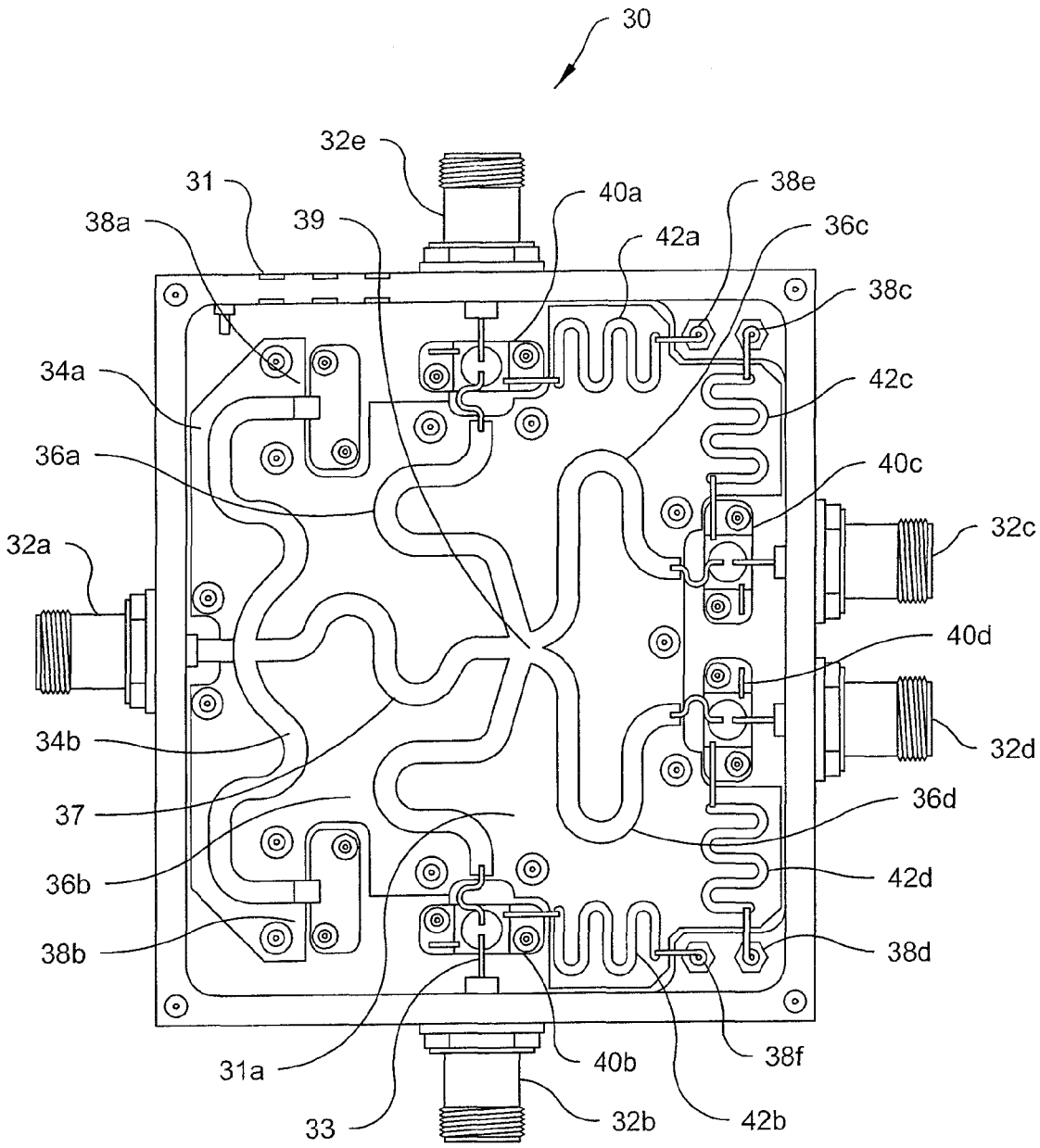
FIG. 2 is an top elevation view of the switch according to an embodiment of the present invention.

The switch 10 is electrically configured as in FIG. 1*a* however its physical assembly is mechanically configured as in FIG. 2, where the electrical elements of resistance, inductance and capacitance shown in FIG. 1 are distributed elements in several instances. The element 22*a* is a transmission line. The respective input inductors 24*a-n* and respective output inductor 26*a-n* are distributed inductors. Regarding the distributed elements, the connection lines are chosen in virtue of the physical material properties necessary to achieve required electrical properties. This generally includes materials having specific physical properties configured with physical dimensions, form and typology. The techniques for constructing distributed inductances and resistances are well known to those of ordinary skill in the art of designing RF electronic circuits.

With reference to FIG. 2 one embodiment of the present invention is a microwave assembly 30 for selectively switching an RF signal from an input port 32*a* to one of a plurality of output ports 32*b-d* that includes a conductive housing 31 wherein an RF circuit mounts in electrical isolation on one side 31*a* (FIG. 5) of said housing 31 and a controller in electrical isolation mounts on an opposite side 31*b* (FIG. 5) of said housing 31. As indicated above, the distributed elements and the connection lines are chosen in virtue of the physical material properties necessary to achieve required electrical properties.

Figure 3:
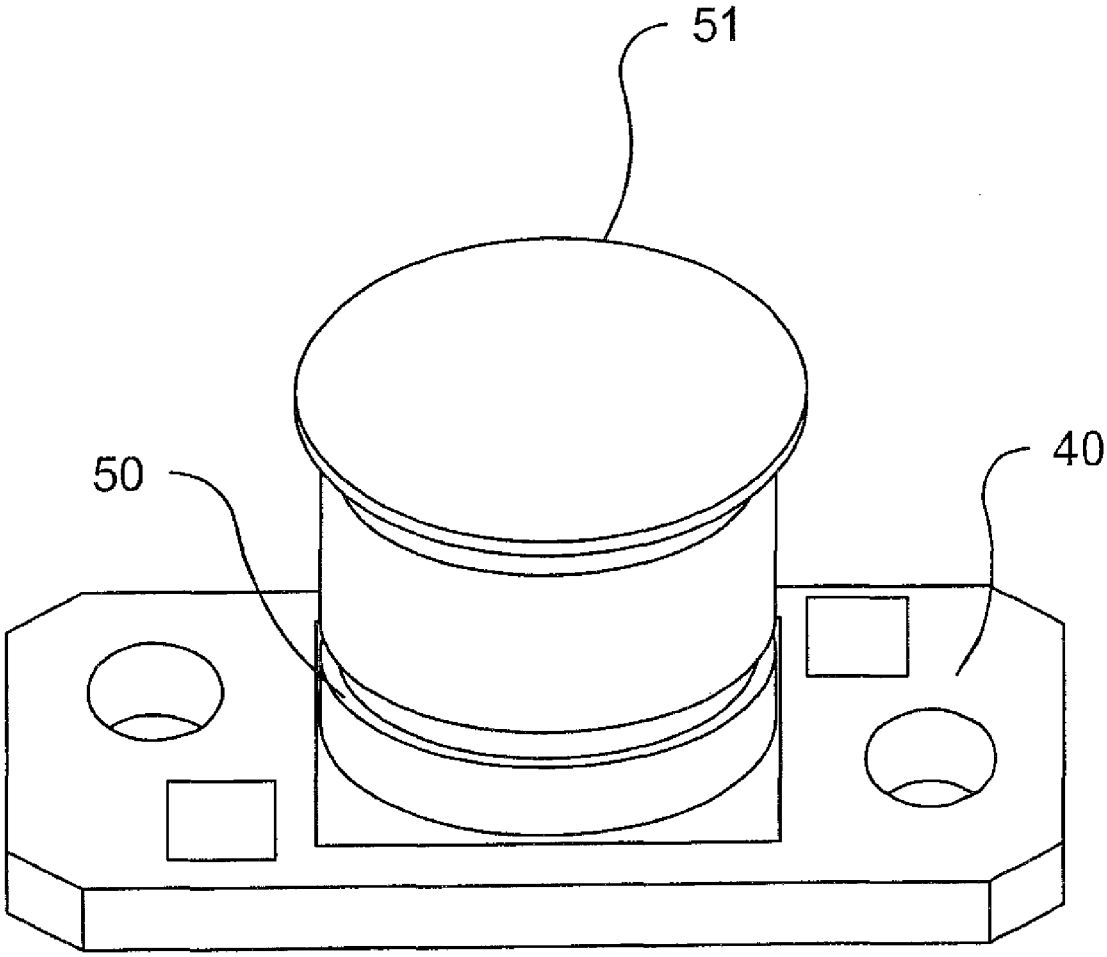
FIG. 3 is a perspective view of a capacitor assembly according to an embodiment of the present invention.
Figure 5:
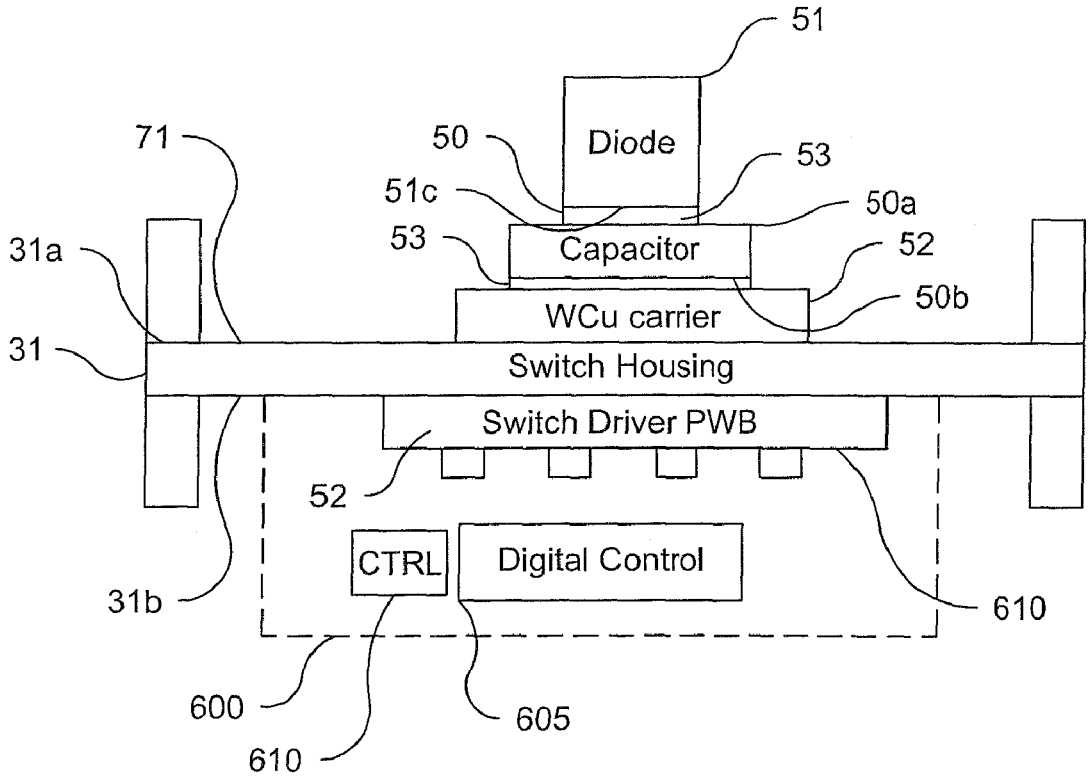
FIG. 5 is representation of the mounting of the diode, capacitor, and carrier onto the switch housing according to an embodiment of the present invention.

Referring to FIGS. 2, 3 and 5, certain physical embodiments of the RF circuits include a physical transmission line 37 (having the equivalent resistance FIG. 1*a*, 20) that attaches to the physical throw junction 39 attached a plurality of physical switch legs 36*a-d*. Each of the physical switch legs 36*a-d* attach to an associated single shunt silicon PIN diode package 51, whose anode is spaced about ¼-wavelength from the physical throw junction 39. The PIN diode package 51 and the chip capacitor package 50 mount on a sub assembly referred to generally as 40 within the housing 31. Note that each subassembly 40*a-d*, FIG. 2 is representative of subassembly 40, FIG. 3. Physical connections 34*a-b* represent FIG. 1*a* inductors 12, 18 and transmission (shunt) lines 14, 16, respectively. Each of the connections 34*a-b* are mounted for external electrical connections to blocks 38*a-b*, respectively. Physical connections 42*a-d* represent the inductors and the capacitors in FIG. 1*a*reference 23*a-n*, 25*a-n*. Each of the connections 42*a-d* are mounted for external electrical connections to blocks 38*c-f*, respectively. The controller digital control circuits (FIG. 6) supplying the DC bias for switching the PIN diodes is fed via block 38*c-f*.

Figure 4:
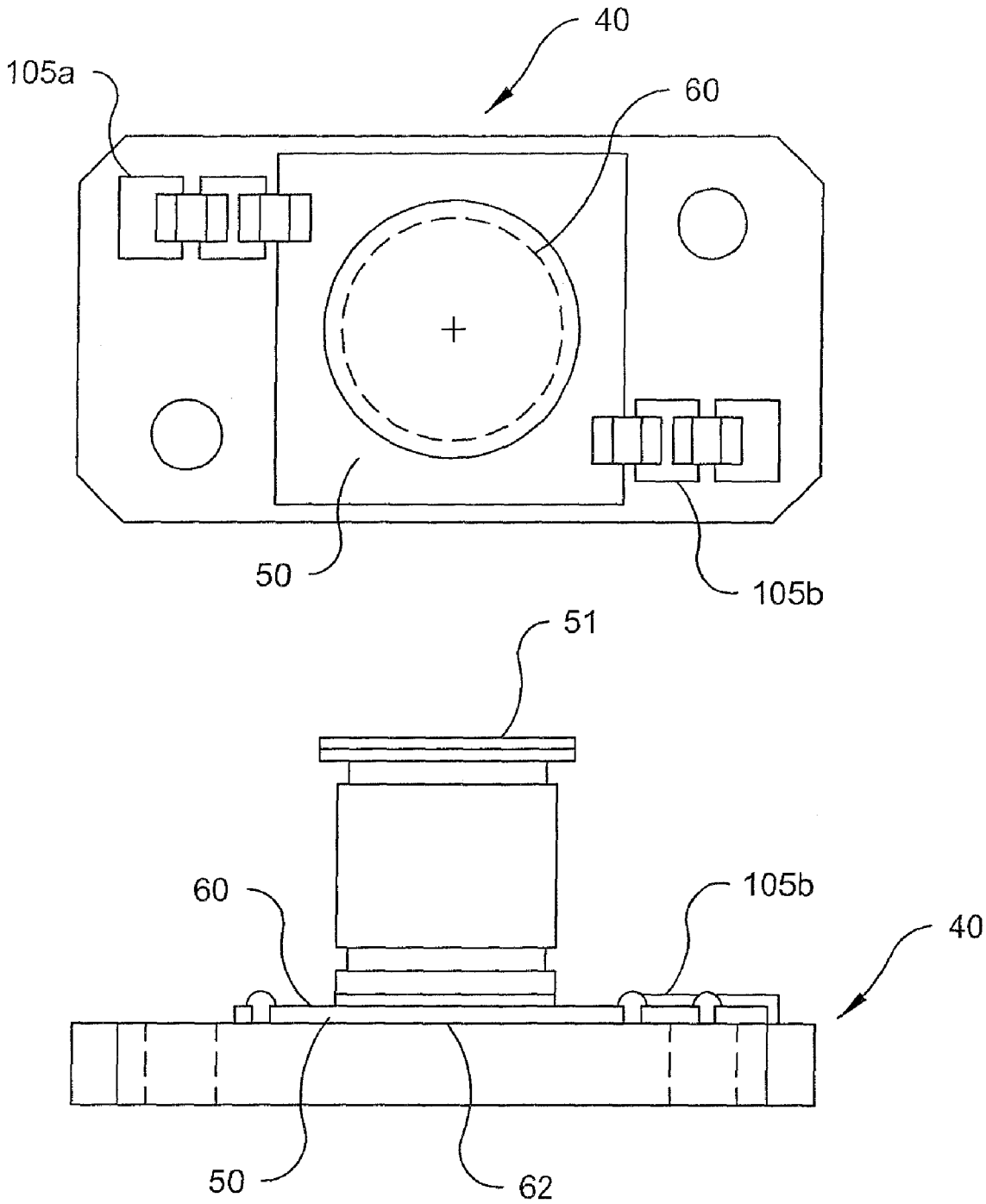
FIG. 4 is a front elevation view of the capacitor assembly according to an embodiment of the present invention.

With further reference to FIGS. 3, 4, and 5, in one embodiment of the present invention, the large chip capacitor package 50 includes therein upper plate 50*a* upper portion 60. The capacitor package 50 lower plate 50*b* attaches to a lower portion 62 of the capacitor package 50. The upper and the lower portions are electrically isolated from each other. The PIN diode package 51 mounts to the capacitor package 50 upper plate 50*a* upper portion 60 and each mount into sub assembly 40, which represents sub assemblies 40*a-d,* FIG. 2, that in turn mount into housing 31. The capacitor package 50 lower plate 50*b* attaches to the capacitor package 50 that mounts to an electrical ground established via a tungsten-copper carrier 52. The electrical association of the each PIN diode package 51 cathode 51*c* to the large chip capacitor package 50 serves to tune out the diode's parasitic frequencies and resonate out the diode package inductance (See, FIG. 1*b*). The DC bias is injected to PIN diode cathode 51*c* via an RF physical choke FIG. 2, 42*a-c* (equivalent to inductors 23*a-n,* FIG. 1*a*) electrically attached to the upper plate 50*a* of the large chip capacitor package 50. As indicated the capacitance provided for blocking capacitor 28*a-n* is a result of tuning, through the addition of capacitors in parallel. As further shown in FIG. 4, in one embodiment a total capacitance for each of the capacitors 28*a-n* (FIG. 1*a*) is achieved through the installation of capacitors 105*a*, 105*b*, which attach to each capacitor 28*a-n* upper plate 50*a* and lower plate 50*b* forming a parallel network.

The high power operation of the assembly 30 requires proper heat management as provided by heat sink 71, which in the preferred embodiment doubles as the separating wall between compartments 31*a* and 31*b*. As shown further in FIG. 5, the controller digital electronics driver assembly 52 mounts to the heat sink 71.

Figure 6:
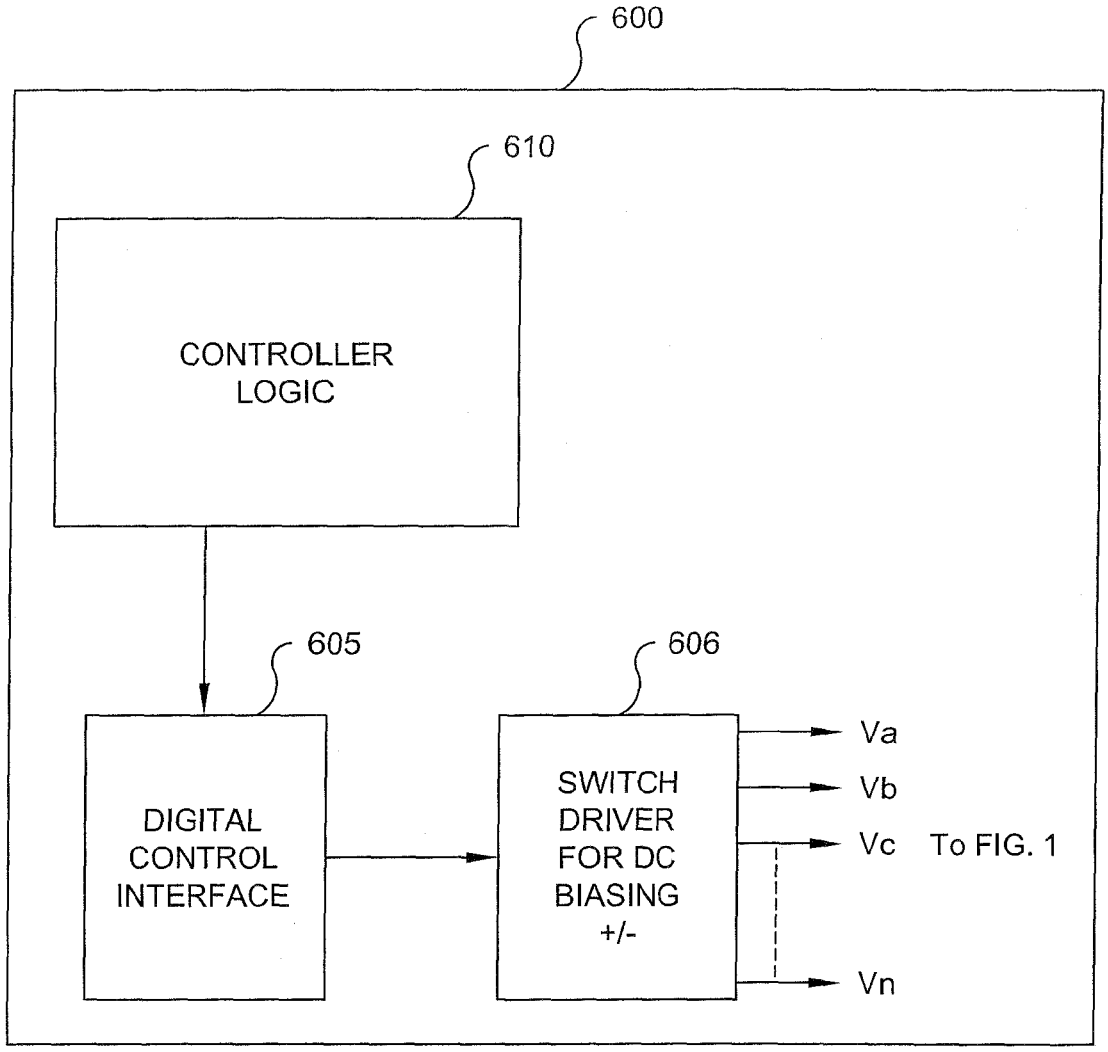
FIG. 6 is a block diagram of the control for a switch according to an embodiment of the present invention.

With reference to FIG. 6, the selected throw is provided by a controller 600 having a controller logic 610 embodied as one or more microprocessors and memory coupled and responsive to the data on the various I/O ports to perform the control features and state indicators for the assembly. A digital control interface 605 is operatively coupled to controller logic module 610 to control the state of an associated switch driver 606 that applies either a positive or negative DC bias, Va-n, to each diode 27*a-n* (FIG. 1) dependent upon the state of controller logic 610. It is understood that the processing and associated processors used in providing switching logic and signals can be implemented in hardware, software, firmware, or combinations thereof. It is also to be appreciated that, where the functionality selection is implemented in either software, firmware, or both, the processing instructions can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions. Generally the software processes may exist in a variety of forms having elements that are more or less active or passive. For example, they may exist as software program(s) comprised of program instructions in source code or object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals are signals that a computer system hosting or running the computer program may be configured to access, including signals downloaded through the Internet or other networks. Examples of the foregoing include distribution of the program(s) on a CD ROM or via Internet download.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A single pole multiple-throw microwave switch for selectively switching an RF signal to one of a plurality of output ports comprising:

a transmission line for coupling the signal to a throw junction, said throw junction having connected thereto a plurality of switch legs, each said leg including a high voltage shunt diode spaced about one quarter-wavelength from the throw junction; each said diode mounted at its cathode end to a corresponding plurality of parallel DC blocking capacitors and adapted to receive a bias voltage;

a controller that applies a first DC bias voltage to a selected one of the shunt diodes to cause the selected shunt diode to operate in a reverse bias mode and applies a second DC bias voltage to the other shunt diodes to cause the other shunt diodes to operate in a forward bias mode such that the selected shunt diode mounted on the corresponding capacitors provides a low insertion loss to pass the signal from the transmission line through a selected leg and to a selected output port; and wherein the other shunt diodes provide a high insertion loss for blocking the signal from the transmission line to the remaining plurality of output ports.

2. The switch of claim 1, wherein shunt lines connect to the transmission line providing a DC path for current flowing through the other shunt diodes.

3. The switch of claim 2, wherein each shunt line includes a series inductor.

4. The switch of claim 1, wherein the shunt diode is a PIN diode.

5. The switch of claim 1, wherein the shunt diode connects to a node that joins an input inductor and an output inductor.

6. The switch of claim 5, wherein a transmission line joins the input inductor to the throw junction.

7. The switch of claim 5, wherein the input inductor and the output inductor are distributed inductors.

8. The switch of claim 2, wherein the shunt lines are in parallel and feed the junction to extend bandwidth of said switch.

9. The switch of claim 1, wherein the controller includes a digital control and an associated switch driver to apply one of either a positive or negative DC bias to each leg of the single pole switch dependent upon the state of the controller.

10. A single-pole multi-throw microwave assembly for switching an RF signal from an input port to a selected one of a plurality of output ports comprising:

a conductive housing;

an RF circuit mounted in electrical isolation on one side of said housing;

a controller circuit in electrical isolation mounted on an opposite side of said housing;

said RF circuit including a throw junction attached to a plurality of switch legs, each of said switch legs attached to a corresponding single shunt silicon PIN diode having an anode connected to and spaced about ¼-wavelength from the throw junction, wherein said PIN diode includes a cathode that connects to the controller circuit for applying a DC bias and further mounts in electrical contact to an upper plate of a capacitor; and wherein said capacitor includes a lower plate in electrical contact to the housing; and each of said switch legs further attaches to the output for providing a low impedance connection between the input port and the selected one of the plurality of output ports dependent upon the controller for applying a DC bias.

11. The assembly of claim 10, wherein the RF circuit further includes a transmission line from an RF source to the throw junction.

12. The assembly of claim 10, wherein the power capacity of the assembly is in the range of 10-25kW.

13. The assembly of claim 10, wherein said PIN diode is contained in a diode package wherein said package mounts to said capacitor in a sub assembly that mounts in electrical contact with the housing.

14. The assembly of claim 13, wherein the capacitor includes an upper plate attached to an upper portion of the capacitor package.

15. The assembly of claim 14, wherein the capacitor includes a lower plate attached to a lower portion of the capacitor package.

16. The assembly of claim 14, wherein the PIN includes a cathode attached to an upper portion of the capacitor package.

17. The assembly of claim 16, wherein a mount attaches the PIN diode cathode to the upper portion of the capacitor package.

18. The assembly of claim 15, wherein the capacitor the lower portion of the capacitor package mounts to electrical ground.

19. The assembly of claim 18, wherein the attachment of the PIN diode cathode to the capacitor tunes out diode parasitics and resonates out the diode package inductance.

20. The assembly of claim 10, wherein the switch, the controller circuit includes a digital control and switch driver.

* * * * *